US008443771B2

(12) United States Patent
Gelez et al.

(10) Patent No.: US 8,443,771 B2
(45) Date of Patent: May 21, 2013

(54) METHOD OF CONTROLLING AN ACTUATOR HAVING A MOVABLE MEMBER WITH POSITIONAL FEEDBACK CONTROL

(75) Inventors: Nicolas Gelez, Le Pecq (FR); Emmanuel Talon, Verneuil-sur-Seine (FR); Boris Bouchez, Cergy le Haut (FR)

(73) Assignee: Valeo Systemes de Controle Moteur, Cergy Saint Christophe (FR)

( * ) Notice: Subject to any disclaimer, the term of this patent is extended or adjusted under 35 U.S.C. 154(b) by 18 days.

(21) Appl. No.: 13/299,867

(22) Filed: Nov. 18, 2011

(65) Prior Publication Data

US 2012/0061598 A1 Mar. 15, 2012

Related U.S. Application Data

(63) Continuation of application No. 12/091,612, filed as application No. PCT/FR2006/002514 on Nov. 14, 2006, now abandoned.

(30) Foreign Application Priority Data

Nov. 25, 2005 (FR) ..... 05 11938

(51) Int. Cl.
*F01L 9/04* (2006.01)

(52) U.S. Cl.
USPC ..... 123/90.11; 123/90.15; 123/90.16

(58) Field of Classification Search
USPC ..... 123/90.11, 90.15, 90.16
See application file for complete search history.

(56) References Cited

U.S. PATENT DOCUMENTS

2003/0217714 A1* 11/2003 Yoeda et al. ..... 123/90.11
2004/0173171 A1* 9/2004 Yamada et al. ..... 123/90.11
2005/0269536 A1* 12/2005 Gelez ..... 251/129.01

* cited by examiner

*Primary Examiner* — Zelalem Eshete
(74) *Attorney, Agent, or Firm* — Osha Liang LLP

(57) ABSTRACT

A valve actuator for a combustion engine has a movable member for collaborating with a stem of a valve, and an electromagnetic device with a permanent magnet associated with a resilient device for moving the movable member between an extreme valve-closed position and an extreme valve-open position. A method of controlling the valve actuator has the steps of determining a clearance range between the movable member and the valve stem during the movement of the movable member between the extreme closed and open positions, determining, in the clearance range, intermediate positions reached by the movable member as a function of different values of an electrical control parameter of the electromagnetic device, and using positional feedback control to control the electromagnetic device, using one of the intermediate positions as a setpoint value, according to the desired performance of the actuator.

3 Claims, 1 Drawing Sheet

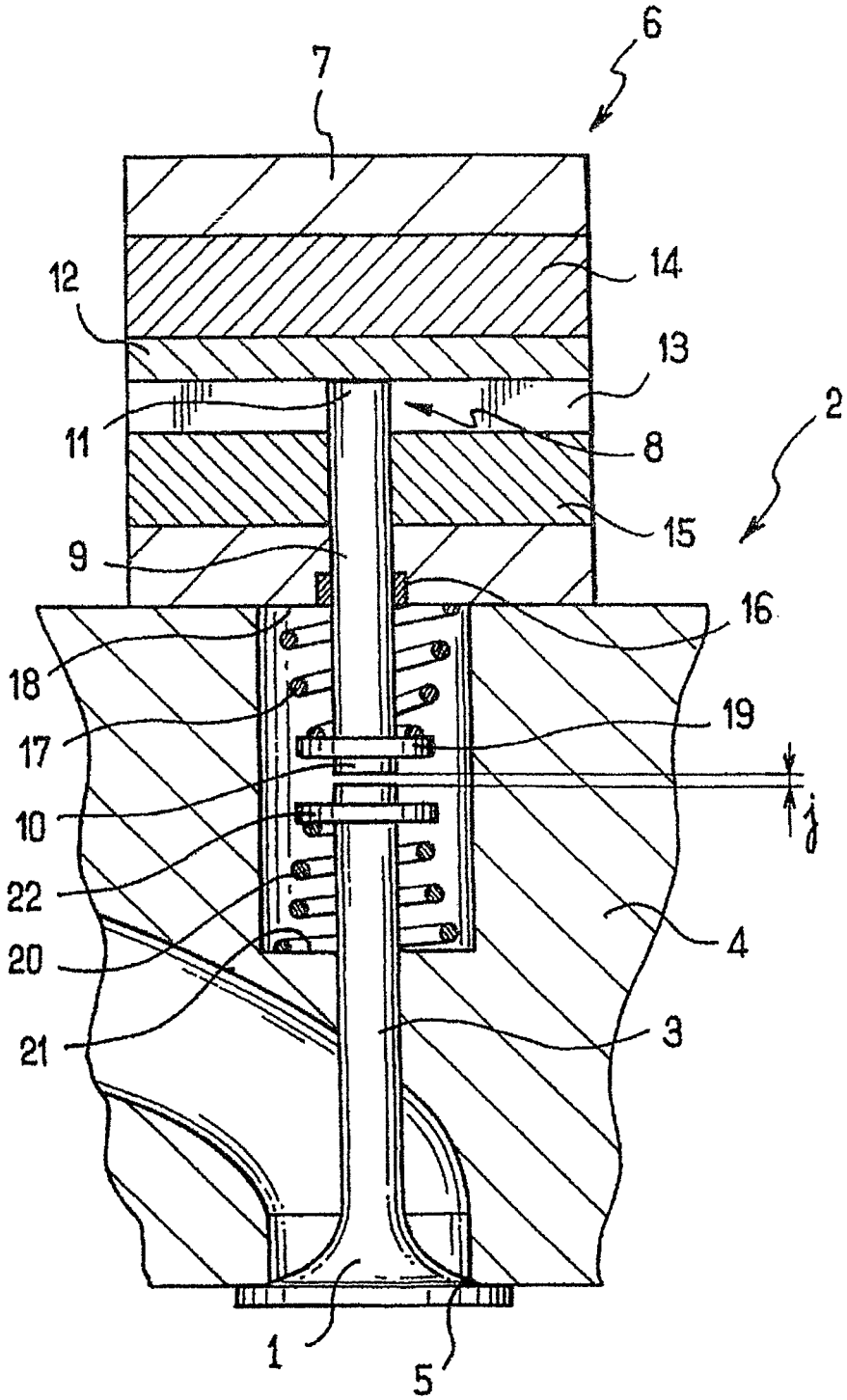
6
7
14
12
13
2
11
8
15
9
16
18
19
17
10
22
4
20
21
3
1
5

METHOD OF CONTROLLING AN ACTUATOR HAVING A MOVABLE MEMBER WITH POSITIONAL FEEDBACK CONTROL

The present invention relates to a method of controlling an electromagnetic actuator of a valve of a combustion engine such as the combustion engine of a motor vehicle.

TECHNICAL BACKGROUND

There are existing electromagnetic valve actuators which conventionally comprise resilient means and electromagnetic means for actuating the movable member between two extreme positions corresponding, respectively, to the valve-open position and to the valve-closed position. The resilient means generally comprise a spring associated with the movable member to return the latter in a resilient way to its extreme open position, and a spring associated with the valve stem to return the latter in a resilient way to its closed position and to return the movable member in a resilient way toward its extreme closed position. The electromagnetic means generally comprise an electromagnet for bringing the movable member to the extreme open position and/or for maintaining it there, and an electromagnet for bringing the movable member to the extreme closed position and/or for maintaining it there. The electromagnet is frequently associated with a permanent magnet in order to limit the power consumption of the electromagnet. The arrival of the movable member at its extreme closed position in which it is in contact with the armature of the electromagnet generates noise.

In order to ensure that the valve is correctly pressed against its seat when the movable member is in its extreme open position, the movable member and the valve are not connected to each other, and there is a clearance, commonly called the "valve clearance", between the movable member and the valve when the movable member is in the extreme closed position and the valve is correctly pressed against its seat by the spring associated with it.

To reduce the noise of the contact of the movable member with the electromagnet on the closure of the valve, it has thus been proposed that the movable member be halted as soon as it has departed from the stem of the valve which has reached the point at which it is pressed against its seat.

However, the valve clearance varies in the course of the operation of the engine, for example as a function of the temperature, and also over the lifetime of the engine, for example as a function of the wear of the valve and of the various components of the valve actuator. The valve clearance can also vary from one actuator to another as a function of the manufacturing tolerances of the actuators.

It is therefore difficult to halt the movable member within the valve clearance range, and there is a risk that the movable member may be halted while the movable member is still in contact with the stem of the valve, thus preventing the valve from being correctly pressed against its seat.

OBJECT OF THE INVENTION

One object of the invention is to provide a method for optimizing the operation of the actuator.

SUMMARY OF THE INVENTION

For this purpose, the invention proposes a method of controlling a combustion engine valve actuator, the actuator comprising a movable member for collaborating with a valve stem, electromagnetic means with a permanent magnet associated with resilient means for moving the movable member between an extreme valve- closed position and an extreme valve-open position, the method comprising the steps of:

- determining a clearance range between the movable member and the valve stem during the movement of the movable member between the extreme closed and open positions,
- determining, within the clearance range, intermediate positions reached by the movable member as a function of different values of an electrical control parameter of the electromagnetic means,
- using positional feedback control to control the electromagnetic means, using one of the intermediate positions as a setpoint value, according to the desired performance of the actuator.

The positional feedback control of the electromagnetic means based on a setpoint position located in the previously determined clearance range enables the movable member to be halted precisely in the desired position and enables the operation of the actuator to be adapted, for example, to the operating conditions of the combustion engine.

In a first embodiment, the setpoint position is the intermediate position for which the electrical control parameter has a minimum value.

The movable member is then at least partially held in position by the permanent magnet, thus enabling the power consumption of the electromagnetic means to be limited.

In a second embodiment, the setpoint position is the intermediate position corresponding to a minimum distance between the movable member and the valve stem.

The movable member travels rapidly over the minimum distance which is left between the movable member and the valve stem, in such a way that the movement of the movable member toward the open position causes the valve to move almost immediately.

Other characteristics and advantages of the invention will be made clear by the following description of a non-limiting specific embodiment of the invention.

BRIEF DESCRIPTION OF THE DRAWINGS

Reference will be made to the single attached figure which shows schematically a combustion engine valve associated with its actuating device.

DETAILED DESCRIPTION OF THE INVENTION

The invention is described here in its application to the actuation of a valve 1 of a combustion engine indicated by the general reference 2.

The valve 1 has a stem 3 and is mounted on a cylinder head 4 of the combustion engine 2 so as to slide between a closed position in which the valve is pressed against a seat 5 of the cylinder head 4 and an open position in which the valve is separated from the seat 5 of the cylinder head 4.

The valve is actuated between these two positions by means of an actuator generally indicated by the numeral 6, mounted on the cylinder head 4 of the combustion engine 2.

The actuator comprises a body 7 in which is slidably mounted a movable member indicated generally by the numeral 8, with a rod 9 having a first end 10 positioned to bear on a free end of the stem 3 of the valve 1 and a second end 11 fixed to a plate 12 received in a housing 13 of the body 7 in such a way that it can slide parallel to the rod 9.

The body 7 incorporates, in a known way, electromagnetic means 14 and 15 for moving the movable member 8.

The electromagnetic means 14 include, in a known way, an electromagnet for attracting the plate 12 toward a position called the extreme valve-closed position and an electromagnet for attracting the plate 12 toward a position called the extreme valve-open position, which open on two opposite faces of the housing 13 of the body 7. Each electromagnet comprises a coil wound on an armature with which a permanent magnet is associated in a known way. The permanent magnet completely or partially holds the plate in the corresponding position. In this case, the plate 12 is in contact with the armature of the electromagnetic means 14, 15 when it is in the corresponding extreme position.

The electromagnetic means 14, 15 are controlled in a known way, using feedback control means (not shown) based on a setpoint current and a velocity of movement of the movable member 8. This feedback control method is known. The feedback control means are also arranged to permit feedback control as a function of a setpoint position. This feedback control can be provided by the engine control unit which also uses a signal indicating the velocity of the plate 12 obtained by derivation from a position signal supplied by a sensor 16 of the position of the rod 9. The position sensor 16 is, for example, a Hall effect sensor of a known type.

The actuator also comprises, in a known way, resilient movement means.

The resilient movement means comprise, in a known way, a spring 17 interposed between a face 18 of the body 7 and a shoulder 19 of the rod 9, to return the plate 12 to the extreme open position, and a spring 20 interposed between a face 21 of the cylinder head 4 and a shoulder 22 of the valve stem 3, to return the valve 1 to the closed position.

The actuator, the cylinder head 4 and the valve 1 are arranged in such a way that, when the plate 12 is in the extreme closed position and the valve 1 is pressed against its seat 5, there is a clearance j, or valve clearance, between the first end 10 of the rod 9 and the free end of the valve stem 3.

The method according to the invention commences with the step of determining the clearance j during the operation of the combustion engine.

The method according to the invention comprises the step of controlling the electromagnetic means 14, 15 to move the movable member 8 at a substantially constant velocity from its extreme closed position toward its extreme open position. The velocity of movement of the movable member can be held constant up to the extreme open position or over a distance exceeding a maximum possible clearance, allowance being made for the geometrical characteristics of the actuator, the valve and the cylinder head.

Simultaneously, the method comprises the step of obtaining the values of the setpoint current for intermediate positions of the movable member during the movement of the movable member 8 from the extreme closed position to the extreme open position, and the step of detecting an intermediate position of the movable member 8 for which the setpoint current undergoes an abrupt variation.

The setpoint current is supplied by the feedback control means (although it could be measured or detected), and the intermediate positions of the movable member 8 are supplied by the position sensor 16.

The setpoint current is then related to the intermediate positions of the movable member 8.

The detection of the intermediate position for which the setpoint current undergoes an abrupt variation is preferably carried out on the basis of the derivative of the setpoint current with respect to the position of the plate 12. When this derivative is plotted in the form of a curve, the curve has peaks at the intermediate position corresponding to the point at which the movable member 8 meets the valve stem 3.

When the extreme closed position is known, the distance between this extreme closed position and the aforementioned intermediate position can be deduced therefrom. This distance is the clearance j.

The method then comprises the step of selecting as a setpoint one of the intermediate positions located within the clearance j, according to the desired performance of the actuator.

If minimum power consumption of the actuator is desired, the selected setpoint is the intermediate position in which the supply current of the electromagnetic means 14 is zero (when the attractive force of the corresponding permanent magnet compensates for the force of the spring 17) or as small as possible (when the attractive force of the permanent magnet is maximal).

If reactivity of the actuator is desired, for example for high operating speeds of the combustion engine, the selected setpoint position is the intermediate position corresponding to a minimum distance between the rod 9 and the stem 3.

In the subsequent movements of the plate, the setpoint position becomes the closed position of the plate in which the rod 9 is separated from the stem 3 of the valve 1 which continues to be pressed against its seat 5 by the spring 20.

It should also be noted that, when the valve clearance is known, it is possible to control the electromagnetic means more efficiently. Thus, when the movable member 8 moves from the closed position to the extreme open position, the electromagnetic means can be controlled in such a way that they initially take the movable member 8 slowly to the intermediate position determined above in order to bring the movable member 8 into contact with the valve stem 3, and then accelerate the movable member 8 as soon as it bears against the valve stem.

When the movable member 8 moves from the extreme open position to the extreme closed position, the electromagnetic means can be controlled in such a way that they initially take the movable member 8 rapidly to the intermediate position corresponding to the start of the clearance j in order to close the valve rapidly, and then bring the movable member 8 slowly to the closed position in order to limit the noise of the contact of the plate 12 with the electromagnet 14.

The determination of the clearance j and of the intermediate positions is preferably repeated periodically, for example once per second.

Clearly, the invention is not limited to the embodiment described above, but incorporates all variants falling within the scope of the invention as defined by the claims.

In particular, the clearance j can be determined by different operating modes, according to the operating mode of the engine and the engine speed.

The clearance can also be determined for a movement of the movable member toward the extreme open position as described above or toward the extreme closed position. In the latter case, the velocity of movement of the movable member will be held substantially constant, for example from a median intermediate position of the plate.

Additionally, the electromagnetic means can be controlled on the basis of another electrical characteristic, such as a setpoint voltage.

The invention claimed is:

1. A method of controlling a valve actuator for a combustion engine, the actuator comprising a movable member for collaborating with a stem of a valve, and electromagnetic means with a permanent magnet associated with resilient means for moving the movable member between an extreme valve-closed position and an extreme valve-open position, the method comprising:

determining a clearance range between the movable member and the valve stem during movement of the movable member between the extreme closed and open positions;

determining, in the clearance range, intermediate positions reached by the movable member as a function of different values of an electrical control parameter of the electromagnetic means; and using positional feedback control to control the electromagnetic means by using one of the intermediate positions located within the clearance range as a setpoint position, wherein the setpoint position correspondes to the closed position of the valve and is selected according to the desired performance of the actuator.

2. The method as claimed in claim 1, in which the setpoint position is the intermediate position for which the electrical control parameter has a minimum value.

3. The method as claimed in claim 1, in which the setpoint position is the intermediate position corresponding to a minimum distance between the movable member and the valve stem.

* * * * *